US011082763B2

(12) United States Patent
Brown

(10) Patent No.: US 11,082,763 B2
(45) Date of Patent: Aug. 3, 2021

(54) HANDHELD ACOUSTIC HAILING AND DISRUPTION SYSTEMS AND METHODS

(71) Applicant: The United States of America, as represented by the Secretary of the Navy, Crane, IN (US)

(72) Inventor: Christopher A Brown, Bloomington, IN (US)

(73) Assignee: The United States of America, as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 16/718,783

(22) Filed: Dec. 18, 2019

(65) Prior Publication Data

US 2021/0195306 A1 Jun. 24, 2021

(51) Int. Cl.

| | |
|---|---|
| ***H04R 1/04*** | (2006.01) |
| ***H04R 3/04*** | (2006.01) |
| ***H04R 29/00*** | (2006.01) |

(52) U.S. Cl.

CPC ..... *H04R 1/04* (2013.01); *H04R 3/04* (2013.01); *H04R 29/004* (2013.01)

(58) Field of Classification Search

CPC . H04R 1/04; H04R 3/04; H04R 1/406; H04R 29/001; H04R 1/342; H04R 1/34; H04R 1/326; H04R 3/00; H04R 29/004; H04R 29/007

See application file for complete search history.

(56) References Cited

U.S. PATENT DOCUMENTS

| | | | | |
|---|---|---|---|---|
| 3,483,940 | A * | 12/1969 | Weisenthal | H04R 1/342 381/91 |
| 2013/0287225 | A1* | 10/2013 | Niwa | H04R 3/00 381/92 |
| 2016/0080537 | A1* | 3/2016 | Kim | H03G 7/002 455/550.1 |

OTHER PUBLICATIONS https://en.wikipedia.org/wiki/Microphone#Shotgun, Wikipedia (Year: 2019).*

SpeechJammer (en), Mar. 2, 2012.,YouTube., entire video, (https://www.youtube.com/watch?v=USDI3wnTZZg).

* cited by examiner

*Primary Examiner* — Yogeshkumar Patel

(74) *Attorney, Agent, or Firm* — Naval Surface Warfare Center, Crane Division; Eric VanWiltenburg

(57) ABSTRACT

The present invention relates to a communication disruption system. In a first audio path, a microphone receives input sound, an amplifier system amplifies the sound, and a sound system transmits a first output sound. In a second audio path, the microphone receives input sound, a delay circuit delays the sound, the amplifier system amplifies the sound, and the sound system transmits a second output sound. A target speaker will hear the first and second output sounds, with the first output sound being a reproduction of their speech heard nearly simultaneously with the original speech, and the second output sound being a reproduction of their speech heard slightly after the original speech. Due to the delayed auditory feedback effect, the target speaker's concentration will be disrupted, making it difficult for them to continue speaking.

7 Claims, 3 Drawing Sheets

HANDHELD ACOUSTIC HAILING AND DISRUPTION SYSTEMS AND METHODS

STATEMENT REGARDING FEDERALLY SPONSORED RESEARCH OR DEVELOPMENT

The invention described herein was made in the performance of official duties by employees of the Department of the Navy and may be manufactured, used and licensed by or for the United States Government for any governmental purpose without payment of any royalties thereon. This invention (Navy Case 200,471) is assigned to the United States Government and is available for licensing for commercial purposes. Licensing and technical inquiries may be directed to the Technology Transfer Office, Naval Surface Warfare Center Crane, email: Cran_CTO@navy.mil

FIELD OF THE INVENTION

The present invention relates to an acoustic hailing and disruption system.

BACKGROUND AND SUMMARY OF THE INVENTION

The present invention relates to an acoustic hailing and disruption (AHAD) system that uses a parametric speaker to disrupt a speaker's ability to speak.

According to an illustrative embodiment of the present disclosure, a target's speech is directed back to them twice, once immediately and once after a short delay. This delay creates delayed auditory feedback (DAF), which alters the speaker's normal perception of their own voice. In normal speech, a speaker hears their own words with a slight delay, and the body is accustomed to this feedback. By introducing another audio feedback source with a sufficiently long delay, the speaker's concentration is disrupted and it becomes difficult to continue speaking. By utilizing directional microphones and speakers, only a target speaker's voice will be picked up by the system, and only a target speaker will hear the transmitted audio.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

The detailed description of the drawings particularly refers to the accompanying figures in which.

DETAILED DESCRIPTION OF THE DRAWINGS

The embodiments of the invention described herein are not intended to be exhaustive or to limit the invention to precise forms disclosed. Rather, the embodiments selected for description have been chosen to enable one skilled in the art to practice the invention.

Figure 1:
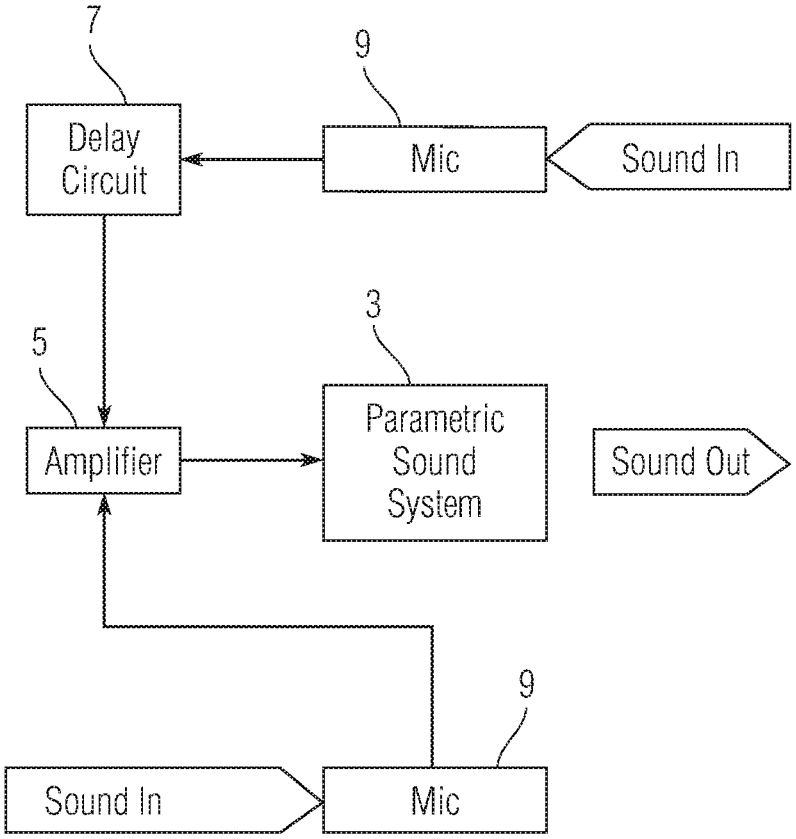
FIG. 1 shows a block diagram of an exemplary AHAD system.

FIG. 1 shows a block diagram of an exemplary AHAD system. In a first audio path, microphone 9 receives input sound, amplifier system 5 amplifies the sound, and sound system 3 (e.g., a parametric sound system) transmits a first output sound. In a second audio path, microphone 9 receives input sound, delay circuit 7 delays the sound (e.g., a 200 ms delay), amplifier system 5 amplifies the sound, and sound system 3 transmits a second output sound.

Figure 2:
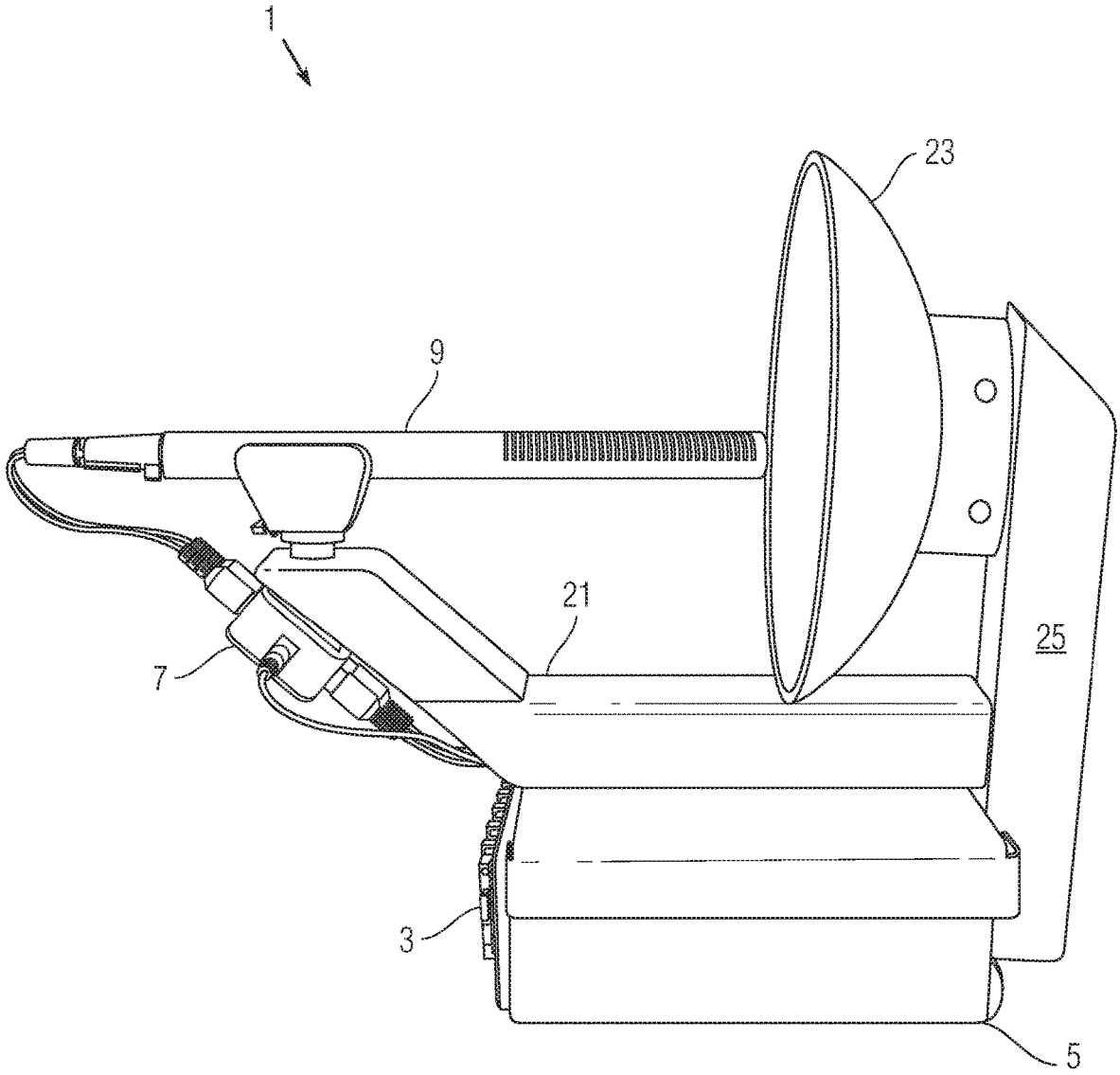
FIG. 2 shows an exemplary AHAD system

FIG. 2 shows an exemplary AHAD system 1. Base 21 can be coupled to amplifier system 5, delay circuit 7, microphone 9, and parabolic reflector 23. Parametric sound system 3 can be coupled to either base 21 or amplifier system 5. Base 21 can have a handle section 25 to allow easy handling by an operator. Parabolic reflector scatters sound received from outside a target trajectory so that microphone 9 only receives sound from the target trajectory. Microphone 9 should be a directional microphone (e.g., a shotgun microphone) and should be aligned with the center of parabolic reflector 23 to further reduce non-target sound inputs. In a first audio path, microphone 9 receives input sound, amplifier system 5 amplifies the sound, and sound system 3 transmits a first output sound. In a second audio path, microphone 9 receives input sound, delay circuit 7 delays the sound (e.g., a 200 ms delay), amplifier system 5 amplifies the sound, and sound system 3 transmits a second output sound. Both audio paths can pass through delay circuit 7, but only one audio path should be delayed. Parabolic reflector 23 should be aligned with sound system 3 such that the output of sound system 3 travels in the same direction as sound received by parabolic reflector 23. With this arrangement, a target speaker will hear the first and second output sounds, with the first output sound being a reproduction of their speech heard nearly simultaneously with the original speech, and the second output sound being a reproduction of their speech heard slightly after the original speech. Due to the delayed auditory feedback effect, the target speaker's concentration will be disrupted, making it difficult for them to continue speaking. A 200 ms can produces maximum disruption for most adults, but the delay can be adjusted (e.g., via a switch, knob, etc. on the delay circuit) to find the optimal delay for a particular target. By using a parametric sound system, only the target speaker will hear the first and second output sounds, so non-targets around the target will not be disrupted. Amplifier system 5 can include a power supply that provides power to amplifier system 5, delay circuit 7, and/or microphone 9. AHAD system 1 can also be used as a regular acoustic hailing device by disabling delay circuit 7 and speaking into microphone 9. By aiming AHAD system 1 at a wall or corner, AHAD system 1 can also project sound to the target surface such that audio appears to originate from the target.

Figure 3:
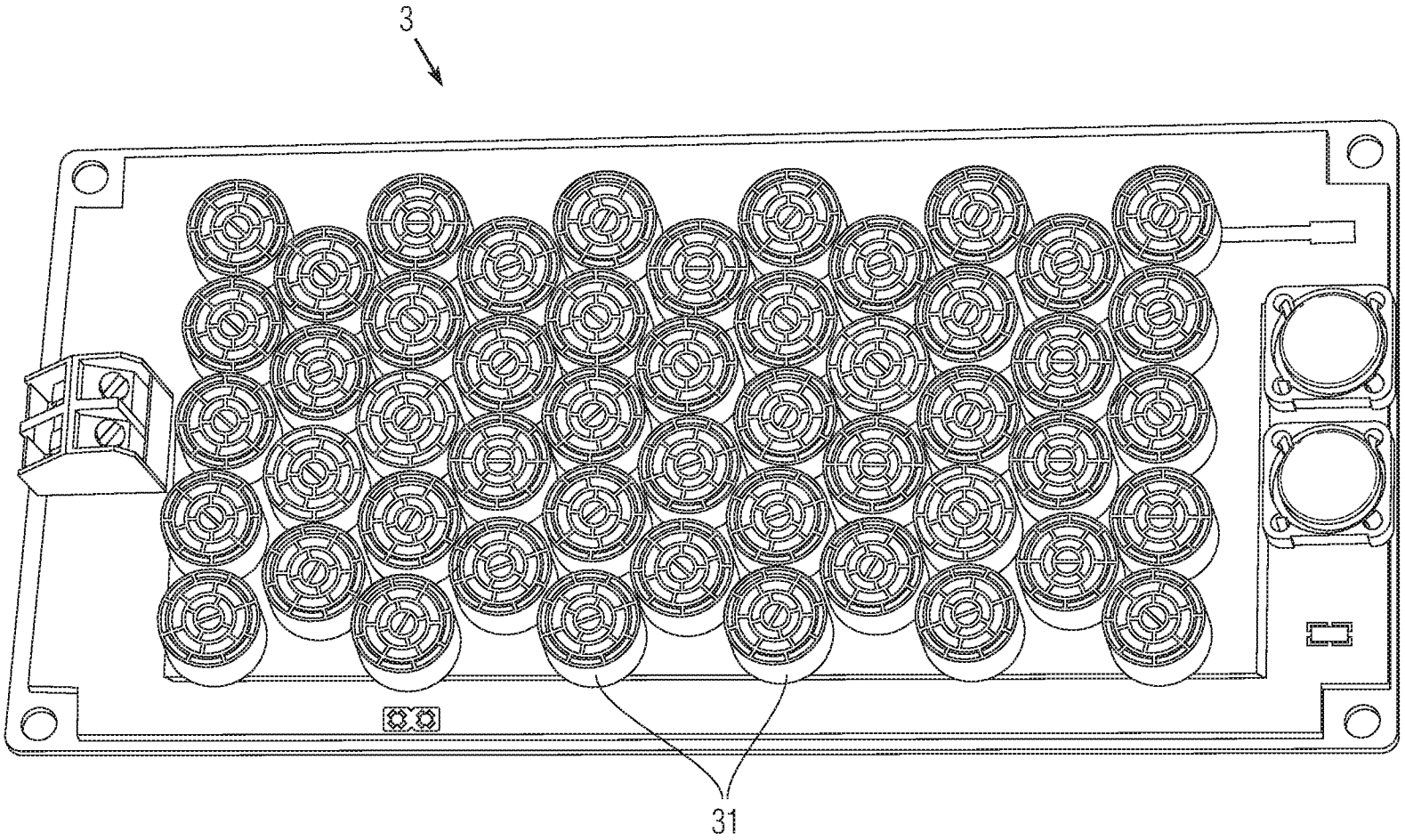
FIG. 3 shows an exemplary parametric sound system.

FIG. 3 shows an exemplary parametric sound system 3. A plurality of parametric speakers 31 output sound in a single direction.

Although the invention has been described in detail with reference to certain preferred embodiments, variations and modifications exist within the spirit and scope of the invention as described and defined in the following claims.

The invention claimed is:

1. An acoustic system comprising:

a microphone;

a delay circuit;

an amplifier system;

a speaker system; and a parabolic reflector;

wherein the microphone, the delay circuit, the amplifier system, and the speaker system are electrically coupled;

wherein the speaker system is configured to transmit a first audio output and a second audio output, wherein the first audio output comprises a first audio input received by the microphone and amplified by the amplifier system, wherein the second audio output comprises the first audio input received by the microphone, delayed a predetermined time by the delay circuit, and amplified by the amplifier system.

2. The acoustic system of claim 1, wherein the microphone is aligned with the parabolic reflector such that a receiving end of the microphone is approximately located at a focal point of the parabolic reflector.

3. The acoustic system of claim 2, wherein the speaker system is aligned with the parabolic reflector such that the first and second audio outputs are transmitting in approximately the same direction as a source of the first audio input.

4. The acoustic system of claim 3, the delay circuit comprising a switch configured to adjust the predetermined time.

5. The acoustic system of claim 3, wherein the microphone is a shotgun microphone.

6. The acoustic system of claim 3, the speaker system comprising at least one parametric speaker.

7. A method of disrupting communication comprising:

providing an acoustic system comprising:

a microphone;

a delay circuit;

an amplifier system;

a speaker system; and a parabolic reflector;

wherein the microphone, the delay circuit, the amplifier system, and the speaker system are electrically coupled;

aiming the acoustic system at a target such that the parabolic reflector collects speech from the target;

transmitting a first audio output towards the target;

after a predetermined period of time, transmitting a second audio output towards the target, wherein the first and second audio outputs comprises the collected speech from the target.

* * * * *